United States Patent [19]

Ward et al.

[11] Patent Number: 4,927,620

[45] Date of Patent: May 22, 1990

[54] PROCESS FOR THE MANUFACTURE OF CARBON FIBERS AND FEEDSTOCK THEREFOR

[75] Inventors: Clifford Ward, Louisa; Eugene Chao, Ashland, both of Ky.; Roy E. Booth, Duncanville, Tex.; Frank H. Turrill, Huntington, W. Va.; Robert H. Wombles, Worthington, Ky.; John W. Newman, Ashland, Ky.; William P. Hettinger, Jr., Russell, Ky.

[73] Assignee: Ashland Oil, Inc., Ashland, Ky.

[21] Appl. No.: 789,590

[22] Filed: Oct. 21, 1985

Related U.S. Application Data

[63] Continuation-in-part of Ser. No. 549,115, Nov. 7, 1983, abandoned, which is a continuation of Ser. No. 446,535, Dec. 3, 1982, Pat. No. 4,497,789, which is a continuation-in-part of Ser. No. 331,443, Dec. 14, 1981, abandoned, which is a continuation-in-part of Ser. No. 963,080, Nov. 22, 1978, abandoned, which is a continuation-in-part of Ser. No. 963,232, Nov. 22, 1978, abandoned, which is a continuation of Ser. No. 838,900, Oct. 3, 1977, abandoned.

[51] Int. Cl.[5] ..... D01F 9/12

[52] U.S. Cl. ..... 423/447.2; 423/447.1; 423/447.4; 423/447.6; 208/22; 208/45; 264/29.2

[58] Field of Search ..... 423/447.1, 447.2, 447.4, 423/447.6; 208/22, 45; 264/29.2

[56] References Cited

U.S. PATENT DOCUMENTS

| | | | |
|---|---|---|---|
| 3,629,379 | 12/1971 | Otani | 264/29.2 |
| 3,767,741 | 10/1973 | Toyoguchi et al. | 423/447.4 |
| 3,801,342 | 4/1974 | Berber et al. | 208/22 |
| 4,219,404 | 8/1980 | Dickakian | 208/22 |
| 4,272,501 | 6/1981 | Greskovich et al. | 264/29.2 |
| 4,277,324 | 7/1981 | Greenwood | 423/447.4 |
| 4,277,325 | 7/1981 | Greenwood | 208/45 |
| 4,283,269 | 8/1981 | Greenwood | 423/447.4 |
| 4,320,107 | 3/1982 | Oyabu et al. | 264/29.2 |
| 4,369,171 | 1/1983 | Grindstaff et al. | 208/22 |
| 4,427,530 | 1/1984 | Dickakian | 208/22 |
| 4,460,454 | 7/1984 | Iijima et al. | 423/447.4 |
| 4,462,893 | 7/1984 | Moriya et al. | 208/22 |
| 4,465,586 | 8/1984 | Diefendorf et al. | 208/45 |
| 4,470,960 | 9/1984 | Uemura et al. | 423/447.1 |

FOREIGN PATENT DOCUMENTS

| | | | |
|---|---|---|---|
| 2109007 | 5/1983 | United Kingdom | 423/447.4 |

*Primary Examiner*—John Doll
*Assistant Examiner*—Robert M. Kunemund
*Attorney, Agent, or Firm*—Richard C. Willson, Jr.; Stanley M. Welsh

[57] ABSTRACT

Disclosed herein is an improved pitch for making readily stabilizable, substantially nonmesophasic carbon fibers. The pitch has a softening point of about 250° C. (480° F.) or above and is produced from an unoxidized thermal petroleum pitch by selectively reducing or eliminating a portion of the low molecular weight materials in a very short period of time so that the tendency to produce mesophase pitch is eliminated or reduced and so that the chemical integrity of the components of the higher molecular weight fractions is preserved as much as possible. Also disclosed is a method of producing carbon fibers therefrom and rovings or mats from such fibers.

15 Claims, 4 Drawing Sheets

PROCESS FOR THE MANUFACTURE OF CARBON FIBERS AND FEEDSTOCK THEREFOR

RELATED APPLICATIONS

The production of carbon fibers from a petroleum pitch is disclosed in U.S. patent application Ser. Nos. 963,080, filed Nov. 22, 1978, and 963,232, filed Nov. 22, 1978, incorporated by reference herein. This application is a continuation-in-part of copending U.S. patent application Ser. No. 549,115, filed Nov. 7, 1983, now abandoned, which is in turn a continuation of U.S. patent application Ser. No. 446,535, filed Dec. 3, 1982, now U.S. Pat. No. 4,497,789, which is in turn a continuation-in-part of U.S. patent application Ser. No. 331,443, filed Dec. 14, 1981, now abandoned, which is in turn a continuation-in-part of U.S. patent application Ser. No. 963,080, filed Nov. 22, 1978, now abandoned, which is in turn a continuation-in-part of U.S. patent application Ser. No. 963,232, filed Nov. 22, 1978, now abandoned, which is in turn a continuation of U.S. patent application Ser. No. 838,500, filed Oct. 3, 1977, now abandoned.

BACKGROUND OF THE INVENTION

Carbon and graphite fibers and composites made therefrom are finding increasing uses in such diverse applications as lightweight aircraft and aerospace structures, automobile parts, and sporting equipment. Due to their high strength per weight ratio further added uses of these composites can be expected in the future.

Typically in the manufacture of carbon or graphite fibers a carbonaceous material is melted, spun into a thread or filament by conventional spinning techniques and thereafter the filament is converted to a carbon or graphite fiber. Conventionally the spun filament is stabilized, i.e., rendered infusible, through a heat treatment in an oxidizing atmosphere and thereafter heated to a higher temperature in an inert atmosphere to convert it into a carbon or graphite fiber.

The prior art discloses many different carbonaceous materials (sometimes called fiber precursors) that may be utilized to manufacture a carbon or graphite fiber. However, the two most significant commercial processes employ mesophase pitch or polyacrylonitrile. Through the use of such materials high strength graphite fibers can be produced.

In order for carbon or graphite fibers to be more widely accepted in commercial applications, improved, more economical fibers must be developed. Three significant manufacturing costs are the preparation of the feedstocks from which the fibers are produced, spinning of the fibers, and the cost of stabilizing the fibers and subsequently converting them to the end product.

In the manufacture of relatively expensive, structured high performance graphite fibers from mesophase pitch one of the most significant costs is the cost of producing the mesophase pitch. Most processes ordinarily require heating of a conventional pitch material at elevated temperatures over a period of several hours. For example, in Lewis et al U.S. Pat. No. 3,967,729, Singer U.S. Pat. No. 4,005,183, and Schulz U.S. Pat. No. 4,014,725, the preparation of the mesophase pitch requires that the initial feedstock be heated to an elevated temperature for a number of hours. Obviously such a process is time consuming and costly. Also care must be taken in heating for a specific time, as mesophase pitch can increase in viscosity rapidly, making it unsuitable for spinning.

The manufacture of graphite or carbon fibers from polyacrylonitrile also employs a relatively expensive feedstock in the process. It is generally thought that the overall cost of producing fibers from polyacrylonitrile is about equal to the cost of producing carbon or graphite fibers from mesophase pitch. With either process the final cost of the graphite fibers is currently $15 to $50 per pound.

Most of the commercial fibers produced from polyacrylonitrile or mesophase pitch have been fibers which have subsequently been converted to graphite fibers. Because the temperature of graphitization if higher than the temperature required to prepare a carbon fiber, graphite fibers are much more costly to produce than carbon fibers. However, certain mechanical properties of graphite fibers are generally superior to those of carbon fibers.

In the past attempts have been made to manufacture carbon fibers from pitch materials without first converting the pitch to the mesophase state. For various reasons these attempts have not been altogether successful and today there exists a need for a commercially economical process for manufacturing lower cost carbon fibers having intermediate mechanical properties from nonmesophase pitch materials, e.g. for asbestos replacement markets.

Various desirable and undesirable characteristics of the fiber precursor have been disclosed in the prior art. For example, Fuller et al U.S. Pat. No. 3,959,448 discloses that shorter stabilization times can be obtained if the softening point of coal tar pitch is increased. However, an attendant disadvantage has been recognized, namely that spinning fibers from coal tar pitch having a softening point of above 200° C. is very difficult. See, for example, Turner et al U.S. Pat. No. 3,767,741. Likewise, it has been recognized that handling carbon fibers made from pitch is relatively difficult. See, for example, Kimura et al U.S. Pat. No. 3,639,953.

Otani U.S. Pat. No. 3,629,379 teaches the use of heat treatment at elevated temperature combined with high vacuum distillation, and heat treatment at elevated temperature combined with admixture of reactive species (peroxides, metal halides, etc.) to produce pitches suitable for melt or centrifugal spinning. The heat treatment step is about one hour, the distillation step is about three hours, and all operations ar batch as opposed to continuous operation. Otani also teaches the desirability of reducing the aliphatic chain components to limit outgassing during carbonization, and the use of the above-cited reactive species to reduce the stabilization time required to prepare the pitch fibers for carbonization.

Besides the softening point, other properties of the pitch material are also important. For example, the presence of impurities and particulates, molecular weight and molecular weight range, and aromaticity. Also, the chemical composition of the pitch material is important, especially insofar as the stabilization of the fiber prior to carbonization is concerned. In fact, various additives and other techniques are taught in the prior art for addition to the pitch material in order to provide a pitch fiber that can be quickly and easily stabilized. See, for example, Barr et al European Patent Application No. 80400136.0 filed 28.01.80 Barr et al, *Carbon* Vol. 16 pp. 439–444 (Pergamon Press 1979), and Otani, U.S. Pat. No. 3,629,379.

OBJECTS OF THE INVENTION

In contrast to the preoccupation of much of the prior art toward the production of mesophase pitch for use in producing graphite fibers, the present invention is directed primarily to the production of nonmesophasic aromatic enriched pitches that can be quickly processed into carbon fibers at a much lower cost and which have excellent intermediate properties permitting them to be used in many applications where asbestos is currently being used.

An important object of this invention has been to provide an economically feasible process for manufacturing carbon fibers from conventional petroleum derived aromatic enriched pitch materials without first having to produce expensive mesophase pitch. Another important objective of this invention has been to provide an improved high softening point, i.e., 249° C. (480° F.) or above and preferably 266° C. (510° F.) or above petroleum derived aromatic enriched pitch material having a high reactivity that can be easily stabilized and that can be carbonized to form carbon fibers suitable for use in high strength composites. Another objective has been to provide an asbestos replacement type carbon fiber. Another important objective has been to provide a process wherein the pitch is converted to a higher softening point material in a very short period of distillation time, preferably from about 1 second to 30 seconds, more preferably from about 5 seconds to 25 seconds and most preferably from about 5 seconds to 15 seconds so that the formation of mesophase pitch is avoided.

Other important objectives of this invention have been to provide a carbon fiber manufactured from aromatic enriched pitch material wherein the fibers are of small diameter thus enabling them to be quickly stabilized and where they have the durability to be handled in the process. These and other objectives of the invention will be apparent to those skilled in the art from the following description and examples.

SUMMARY OF THE INVENTION

One feature of the present invention is to prepare and utilize in a carbon fiber process a high softening point, nonmesophase, quickly stabilizable aromatic enriched pitch material having a normal heptane insolubles content (ASTM D 3279-78) of about 80–90% by weight and the properties set forth in Table I.

TABLE I

| Property | ASTM Test Number | Value |
|---|---|---|
| Softening Point, °C. | D-3104 | At least 249 |
| Xylene Insolubles, % | D-3671 | 15–40 |
| Coking Value, % | D-2416 | 65–90 |
| Helium Density, g/m$^3$ | * | At about 1.25–1.32 |
| Sulfur, % | D-1552 | 0.1–4.0 |

*Determined by Beckman Pyconometer g/cc at 25° C. Percentage numbers are weight percents.

Another feature of the present invention is to prepare the above aromatic enriched pitch material from a pitch material which may be an aromatic base unoxidized carbonaceous pitch material obtained from distillation of crude oils or most preferably the pyrolysis of heavy aromatic slurry oil from catalytic cracking of petroleum distillates. It can be further characterized as an aromatic enriched thermal petroleum pitch. The manufacture of various pitches not necessarily equivalent to the pitches of this invention, is known and is taught in Nash U.S. Pat. No. 2,768,119 and Bell U.S. Pat. No. 3,140,249. The properties of these more conventional pitches are more fully defined in Table II.

Another important aspect of the present invention is the method by which the above-described petroleum pitch is converted to the higher softening point aromatic enriched pitch of the present invention by the removal or elimination of lower molecular weight species. A number of conventional techniques as previously described in Otani, can be employed such as conventional batch vacuum distillation, as pointed out previously, we prefer to use continuous equilibrium flash distillation. A better way of converting the pitch to the higher softening point material is to use a very short residence time wiped film evaporator of the type shown in Monty U.S. Pat. No. 3,348,600 and Month U.S. Pat. No. 3,349,828.

It is especially preferred that over 25 percent by weight, preferably 25% to 50% by weight and most preferably 45 to 55% of the material having a molecular weight of below about 550 is removed or eliminated.

Another important aspect of the present invention has been to use the melt blowing process disclosed in Keller et al U.S. Pat. No. 3,755,527, Harting et al U.S. Pat. No. 3,825,380 and Buntin U.S. Pat. No. 3,849,241 to process the high softening point pitch into the form of a continuous mat of fibers. Continuous filament fibers can also be produced using the die technology cited above.

While this technique has been successfully applied to polymeric material, such as polypropylene, we have been successful in modifying the melt blowing process to permit the production of high quality pitch fiber mats. A survey of the literature fails to reveal the use of melt blowing die technology to produce pitch fibers.

The present invention enables one to manufacture fibers having a very small diameter, e.g. from about 6 to 30, more likely from about 8 to 20 and most selectively from about 10 to 14 microns. Fibers with such diameters admit of certain special applications that larger diameter fibers are not adapted for.

Although not wishing to be bound by any theory, it is believed that the improved results of the invention are due to the fact that the treatment time for increasing the softening point and aromatic enrichment, is purposely kept very short. In keeping the time short and not overly treating the pitch material, the alkyl groups present in the pitch material are not destroyed or removed by thermal dealkylation during the preparation of the high softening point pitch. The percent alpha hydrogens of total hydrogen is about 20 to about 40, more preferably about 25 to about 35 and most preferably from about 28 to about 32. The percentage of beta hydrogen atoms of the total hydrogen atoms is thus preferably from about 2% to 15%, more preferably from about 4% to 12% and most preferably from about 6% to 10%. The percentage of gamma hydrogen atoms of the total hydrogen atoms is thus preferably from about 1% to 10%, more preferably from about 3% to 9% and most preferably from about 5% to 8%.

In Barr et al, "Chemical Changes During the Mild Air Oxidation of Pitch", Volume 16, *Carbon*, pp. 439–444 (1978) the authors note that the greater reactivity of petroleum pitches as compared to coal tar pitches is attributed to a higher concentration of alkyl (methyl, ethyl) side chains in the petroleum pitches. By utilizing a method whereby the softening point of the pitches of the present invention are substantially increased by only brief exposure to high temperatures, these desirable alkyl side chains are preserved. Moreover, as noted below, the chemical composition of the pitch, from the standpoint of speed of stabilization, is enhanced. This preserves the reactivity of the pitch and greatly reduces the time required to stabilize the fiber.

The basic process steps involved in the process include the following:

1. Producing a petroleum pitch from a highly aromatic slurry oil, and subjecting said pitch to vacuum flash distillation or wiped film evaporation, to prepare an enriched unique pitch having a softening point of preferably at least 249° C. (480° F.), more preferably about 265° C. (510° F.) or above, and most preferably 254° C. to 266° C. (490° F. to 511° F.) by treating an unmodified thermal petroleum pitch having a softening point, as measured by Mettler softening point apparatus by ASTM Method D-3104, of about 77° C. to 122° C., and preferably about 122° C.

2. Converting the high softening point aromatic enriched pitch of Step 1 into a roving or mat of pitch fibers, preferably through the use of a melt blowing process as described in the just identified patents.

3. Stabilizing in less than 200 minutes without addition of reactive species to the pitch, more preferably in less than 100 minutes and most preferably in about 50–90 minutes, the pitch fiber roving or mat product resulting from Step 2 in an oxidizing atmosphere at a temperature of between about 180° C. (356° F.) to 310° C. (590° F.), preferably in a continuous, multi-stage heat treatment apparatus under oxidizing conditions.

4. Further heating the resulting infusible roving or mat product of Step 3 to a temperature of about 1000° C. (1832° F.) to 3000° C. (5500° F.), more preferably from about 900° C. to 1500° C. and most preferably from about 1000° C. to 1200° C. in an inert atmosphere in order to carbonize or graphitize roving, mat or continuous filament product.

DESCRIPTION OF THE PREFERRED EMBODIMENTS

Starting Pitch Material

Figure 1:
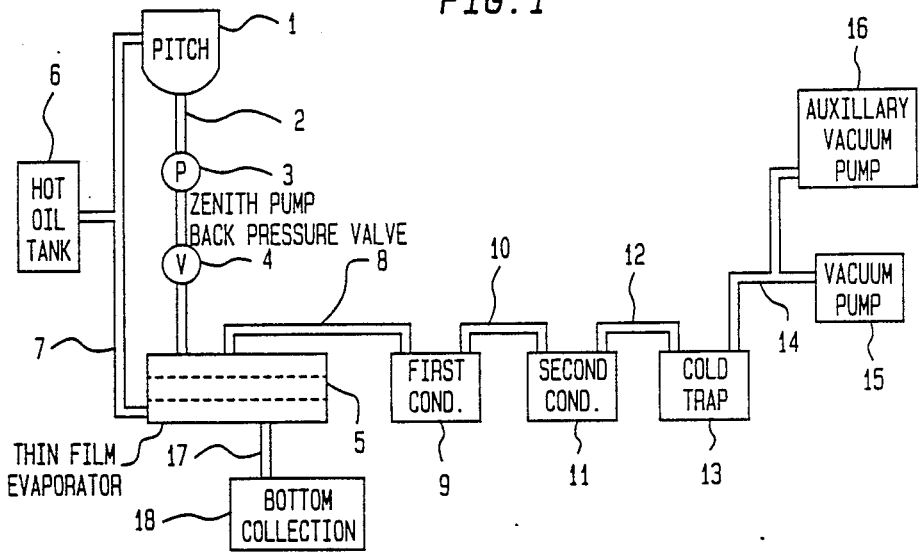
FIG. 1 is a schematic system useful in producing carbon fiber precursor pitch materials from commercially available A-240 pitch sold by Ashland Oil, Inc.

The starting petroleum pitch utilized in the process of the invention is an aromatic base unoxidized carbonaceous pitch produced from heavy slurry oil produced in catalytic cracking of petroleum distillates. It can be further characterized as unoxidized thermal petroleum pitch of highly aromatic content. These pitches remain rigid at temperatures closely approaching their melting points. The preferred procedure for preparing the unoxidized starting petroleum pitch uses, as a starting material, a clarified slurry oil or cycle from which substantially all paraffins have been removed in fluid catalytic cracking. Where the fluid catalytic cracking is not sufficiently severe to remove substantially all paraffins from the slurry oil or cycle oil, they must be extracted with furfural. In either case, the resultant starting material is a highly aromatic oil boiling at about 315° to 540° C. This oil is thermally cracked at elevated temperatures and pressures for a time sufficient to produce a thermally cracked petroleum pitch with a softening point of about 38.7° to about 126.7° C. The manufacture of some other unoxidized petroleum pitch products, although not necessarily considered suitable for use as is Ashland Petroleum Pitch 240, is described in Nash U.S. Pat. No. 2,768,119 and Bell et al U.S. Pat. No. 3,140,249, Table II presents comparative properties of four unoxidized commercially available petroleum pitches (A, B, C, and D) suitable for use as a starting material for use in this invention.

Pitch Alpha and Beta Hydrogens

As mentioned elsewhere in the present specification, the preservation of alpha and beta hydrogens (i.e. alkyl side chains) is a special feature of the present invention. The percentage of alpha and beta hydrogen mentioned above will be preserved in the pitch after all processing is complete to form the pitch fibers.

Alpha and beta hydrogen content can be determined analytically by nuclear magnetic resonance (NMR) techniques. This technique also determines the concentration of other hydrogen types (aromatic, etc.).

Pitch Softening Point

The softening point for the present invention will be determined by methods well known to the industry, preferably ASTM No. D-3104, modified to use stainless steel balls and cup and high temperature furnace in view of the high softening points of the present pitches. Softening point will preferably be in the range of at least 249° C., more preferably from about 265° C. to about 274° C., and most preferably from about 254° C. to about 266° C.

Pitch Xylene Insolubles

The xylene insolubles content of the materials of the present invention should preferably be in the range of from about 0 to about 40 percent by weight, more preferably from about 0 to about 35 percent by weight, and most preferably from about 0 to about 32 percent by weight. Xylene insolubles will be determined by techniques well known to the industry, including ASTM No. D-3671.

Pitch Quinoline Insolubles

Quinoline insolubles of the pitches of the present invention will preferably be from about 0 to about 5 percent by weight, more preferably from about 0 to about 1 percent by weight, and most preferably from about 0 to about 0.25 percent by weight. As quinoline insolubles generally represents either catalyst or free carbon or mesophase carbon, the lowest possible quinoline insolubles content is preferred.

Pitch Sulfur Content

The sulfur content of the pitches of the present invention will be determined by the content of the feed materials, but will preferably be as low as possible. Sulfur contents of from about 0.1 to about 4 percent by weight, more preferably from about 0.1 to about 3 percent by weight, and most preferably from about 0.1 to about 1.5 percent by weight can be used with the invention. Both environmental considerations and the disruption of fiber quality caused by the gasification of the sulfur from the pitch dictate this preference for low sulfur content. Sulfur content is readily determined by ASTM No. D-1551 or other techniques well known to the industry.

Pitch Coking Value

The coking value of the pitches of the present invention will generally be determined by ASTM No. D-2416 and will preferably be in the range of about 65 to about 90 weight percent, more preferably from about 70 to about 85 weight percent, and most preferably from about 75 to about 85 weight percent coke based on the total weight of the pitch. Even higher coking values are, of course, as the coking value represents to a large degree the percent carbon which will remain in the final carbon fiber after stabilization and all other processing has been completed.

Pitch Mesophase Content

The mesophase content of the pitch of the present invention will preferably be as low as possible, though amounts of as much as 5% or even more may be tolerated in special instances. Generally, for economic considerations, amounts of from about 0 to about 5 percent by weight mesophase, more preferably from 0 to about 1 percent by weight mesophase, and most preferably from about 0 to about 0.25 percent by weight mesophase will be useful with the invention. The percent mesophase content of the pitches can be determined by quinoline insolubles, or by optical microscopic techniques, utilizing crossed polarization filters and measuring the area (then calculating as volume and as weight) of the mesophase present under microscopic examination under polarized light.

TABLE II

| Test | Test Method | Pitch A | Pitch B | Pitch C | Pitch D |
|---|---|---|---|---|---|
| Softening Point, °C. | ASTM D-2319 | 78.3 | 115.6 | 115.6 | 126.7 |
| Density, G/cc | Beckman Hc Pyc | 1.192 | 1.228 | 1.210 | 1.239 |
| Mod. Con. Carbon Wt % | ASTM D-2416 | 37.8 | 51.0 | 50.4 | 53.1 |
| Flash, COC, °C. | ASTM D-92 | 316 | 307.2 | 312.8 | 312.8 |
| Sulfur, Wt % | ASTM D-1551 | 2.73 | 2.0 | 10.3 | 2.5 |
| Xylene Ins. Wt % | ASTM D-2317 | 0.7 | 5.0 | 2.2 | 5.8 |
| Quinoline Ins. Wt % | ASTM D-2318 | 0.11 | Nil | Nil | Nil |

BROOKFIELD VISCOSITY USING NO. 2 SPINDLE

| Temperature, °F. | Viscosity, cps | | | |
|---|---|---|---|---|
| 350 | 40 | 395 | 515 | 2000 |
| 325 | 60 | — | — | — |
| 300 | 140 | — | — | — |

The preferred unoxidized enriched petroleum pitch used in this invention has a carbon content of from about 93% by weight to about 95% by weight and a hydrogen content of from about 5% by weight to about 7% by weight, exclusive of other elements. Elements other than carbon and hydrogen such as oxygen, sulfur, and nitrogen are undesirable and should not be present in excess of about 4% by weight preferably less than 4%. The pitch, due to processing, may likely contain a low concentration of hard particles. The presence or absence of particulate matter can be determined analytically and is also quite undesirable. Preferably particulate matter should be less than 0.1%, more preferably 0.01%, and most preferably less than 0.001%. For example, a sample of the pitch under consideration can be dissolved in an aromatic solvent such as benzene, xylene or quinoline and filtered. The presence of any residue on the filter medium which does not soften at elevated temperatures up to 400° C. (as measured by a standard capillary melting point apparatus) indicates the presence of a hard particle material. In another test for suitability, the pitch under consideration is forced through a specially sized orifice. Plugging of the orifice indicates the presence of unacceptably large particles. Ash content can also be used to establish hard particle contamination.

A pitch supplied under the designation A-240 by Ashland Oil, Inc., is a commercially available unoxidized petroleum pitch meeting the above requirements. It is described in more detail in Smith et al, "Characterization and Reproducibility of Petroleum Pitches", (U.S. Dep. Com. N.T.I.S. 1974; Y-1921), incorporated by reference herein. It has the following characteristics.

TABLE III

TYPICAL ANALYSIS FOR A COMMERCIAL PITCH (A-240)

| Test | | Method | Typical Analysis |
|---|---|---|---|
| Softening Point | | ASTM D-2319 | 120° C. |
| Density, g/cc, 25° C. | | Beckman Pyconometer | 1.230 |
| Coking Value | | ASTM D-2416 | 52 |
| Flash, COC, °C. | | ASTM D-92 | 312 |
| Ash, wt % | | ASTM D-2415 | 0.16 |
| BI, °wt % | | ASTM D-2317 | 5 |
| QI, °wt % | | ASTM D-2318 | Nil |
| Sulfur, Wt % | | ASTM D-1552 | 2.5% |
| Distillation, Wt % | | ASTM D-2569 | |
| 0–270° C. | | | 0 |
| 270–300° C. | | | 0 |
| 300–360° C. | | | 2.45 |
| Specific Heat Calories/gm at | | Calculated | |
| −5° C. | | | 0.271 |
| 38° C. | | | 0.299 |
| 93° C. | | | 0.331 |
| 140° C. | | | 0.365 |
| Viscosity, CPS | RPM | Brookfield Thermosel, Model LVT, Spindle #18 | |
| 325° F. | 1.5 | | 2734 |
| 350° F. | 1.5 | | 866 |
| 375° F. | 1.5 | | 362 |
| 400° F. | 3.0 | | 162 |

Preparation of Improved Pitch Material Having Increased Softening Point and High Reactivity In order to produce the high softening point aromatic enriched preferred pitch material of the present invention, the pitch of Table III hereof is treated so as to increase the softening point of the pitch material to about 249° C. (480° F.) or above and to provide the characteristics as set forth in Table I hereof.

The pitch so produced is nonmesophase pitch. By nonmesophase is meant less than about 5% by weight of mesophase pitch. Such a pitch would generally be referred to in the art as an isotropic pitch, e.g., a pitch exhibiting physical properties such as light transmission with the same values when measured along axes in all directions.

In an effort to produce such a pitch material various methods have been tried. As a result, it was discovered that a preferred technique involved the use of a wiped film evaporator. This technique reduces the time of thermal exposure of the product, thus providing a better fiber precursor. A suitable wiped film evaporator is manufactured by Artisan Industries, Inc. of Waltham, Mass. and sold under the trademark Rototherm. It is a straight sided, mechanically aided, thin-film processor operating on the turbulent film principle. Feed, as, for example, pitch material, entering the unit is thrown by centrifugal force against the heated evaporator walls to form a turbulent film between the wall and rotor blade tips. The turbulent flowing film covers the entire wall regardless of the evaporation rate. The material is exposed to high temperatures for only a few seconds. The Rototherm wiped-film evaporator is generally shown in Monty U.S. Pat. No. 3,348,600 and Monty U.S. Pat. No. 3,349,828, incorporated by reference herein. As noted in the '600 patent, the various inlet and outlet positions may be changed. In fact, in actual operation of the Rototherm wiped-film evaporator it has been determined that the feed inlet (No. 18 in the patent) can be the product outlet. The following will serve as examples as to how to produce the high softening point pitch of the present invention.

A number of runs are made using an Artisan Rototherm wiped film evaporator having one square foot of evaporating surface with the blades of the rotor being spaced 1/16" away from the wall. The evaporator employed is a horizontal model with a countercurrent flow pattern, i.e., the liquid and vapors traveled in opposing directions. The condensers employed are external to the unit and for the runs two units are employed along with a cold trap before the mechanical vacuum pump. The unit employed is heavily insulate with fiberglass insulation in order to obtain and maintain the temperatures that are required. A schematic of the system employed is shown in FIG. 1 hereof.

Briefly described, A-240 pitch material is melted in a melt tank 1. Prior thereto, it is filtered to remove contaminants including catalyst fines. It is pumped by Zenith pump 3 through line 2 and through back pressure valve 4 into the wiped-film evaporator 5. The wiped-film evaporator 5 is heated by hot oil contained in reservoir 6 which is pumped into the thin-film evaporator through line 7. As the pitch material is treated in the thin-film evaporator 5, vapors escape the evaporator through the line 8 and are condensed in a first condenser 9 and a second condenser 11 connected by line 10. The vapors then pass through conduit 12 into cold trap 13 and out through line 14. Vacuum is applied to the system from vacuum pump 15. An auxiliary vacuum pump 16 is provided in case of failure of the main vacuum pump.

Feed rates of between 15 to 20 pounds of pitch per hour are utilized which produce about 10 pounds per hour of the higher softening point pitch. The time it takes to increase the softening point is only five to 15 seconds. The absolute pressure employed was between about 0.1 torr and 0.5 torr. The temperature of the unit is stabilized at about 377° C. (710° F.). Table IV below shows the result of three runs designated Run 1008, Run 1009 and Run 1010:

TABLE IV

| Run Designation | S.P. °C. | Xylene Insolubles % | Coking Value % | Helium Density gm/cc | Sulfur % |
|---|---|---|---|---|---|
| 1008 | 245 | 15.2 | 78.1 | 1.260 | 2.69 |
| 1009 | 244 | 17.6 | 78.4 | 1.287 | 2.79 |
| 1010 | 261 | 29.1 | 81.3 | 1.260 | 2.61 |
| ASTM No. | D-3104 | D-3671 | D-2416 | * | D-1551 |

*Determined by Beckman Pyconometer g/cc at 25° C.

For comparative purposes, pitch material is prepared in the following fashion and the run is designated pitch A-410-VR. All products had softening points of about 210° C. (410° F.). Conventional production A-240 pitch as described earlier is filtered through a one micron fiberglass wound filter. About 250 pounds of this pitch is loaded into a conventional vacuum still, subsequently heated to 343°-371° C. (650°-700° F.) and evacuated to between one to two torr. Tables IV (A) and (B) provided added information as to the method of pitch preparation and the resultant properties.

TABLE V (A)

| Run Number | 5521 | 5522 | 5693 | 5855 |
|---|---|---|---|---|
| Charge, kg. to still | 114 | 114 | 114 | 114 |
| Overhead, % | 30 | 29.6 | 28.2 | 32.0 |
| Bottoms, % | 68.8 | 70.4 | 72.0 | 69.4 |
| Vacuum, mm Hg Abs | 1 | 1 | 1 | 2 |
| Final Pot Tem., °C. | 364 | 364 | 335 | 342 |
| Distillation Time, hr. | 17.0 | 13.6 | 27.7 | 19.0 |

TABLE V (B)

| Test | Method | 5521 | 5522 | 5693 | 5855 |
|---|---|---|---|---|---|
| S.P., °C. | D-3104 | 208 | 212 | 212 | 212 |
| XI, % | D-3671 | 19.6 | 19.1 | 21.6 | 16.3 |
| CV, % | D-2416 | — | — | — | 73.5 |
| He Dens., gm/cc | * | 1.260 | 1.289 | 1.275 | 1.268 |
| S, % | D-1552 | 1.1–1.25 | 1.14 | 1.19 | 1.33 |
| Ash, % | D-2415 | 0.04 | 0.04 | 0.03 | 0.05 |

*Determined by Beckman Pyconometer g/cc at 25° C.

Fiber Processing

Without further processing, the increased softening point pitch (AR-510-TF; Run 1009 of Table (IV) is fed to a melt blowing extruder of the type disclosed in Buntin et al U.S. Pat. Nos. 3,615,995 and 3,684,415. These patents describe a technique for melt blowing thermoplastic materials wherein a molten fiber-forming thermoplastic polymer resin is extruded through a plurality of orifices of suitable diameter into a moving stream of hot inert gas which is issued from outlets surrounding or adjacent to the orifices so as to attenuate the molten material into fibers which form a fiber stream. The hot inert gas stream flows at a linear velocity parallel to and higher than the filaments issuing from the orifices so that the filaments are drawn by the gas stream. The fibers are collected on a receiver in the path of the fiber stream to form a non-woven mat.

Fibers are prepared in a like manner using the A-410-VR (Run 5521) pitch material.

Stabilization and Carbonization

Figure 2:
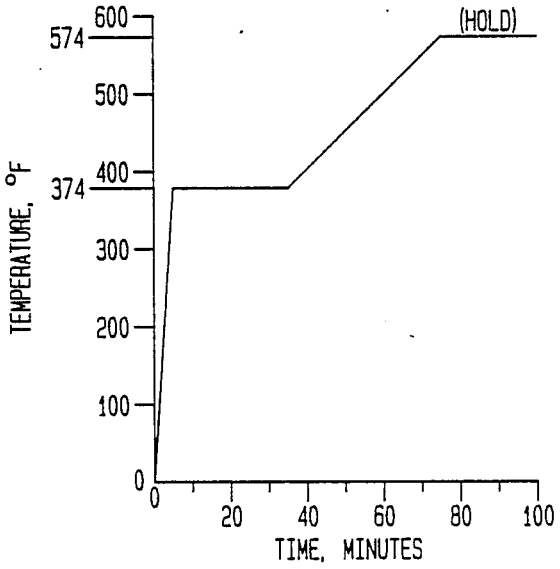
FIG. 2 is a graphic presentation of a fiber stabilization cycle.

The fibers are then stabilized as follows. The fibers made from the AR-510-TF pitch are successfully stabilized in air by a special heat cycle found to be especially suitable. More particularly, it was empirically determined that the stabilization cycle as shown in FIG. 2 can be effectively employed to stabilize the fibers in less than 100 minutes, a time consistent with commercial criteria. More particularly, the 100 minute cycle consists of holding the pitch fibers at approximately 11° C. (20° F.) below the glass transition temperature (Tg) of the precursor pitch (i.e. about 180° C. [356° F.]) for about 50 minutes. This is followed by an increase to about 200° C. (392° F.) and holding 30 minutes at that temperature. The temperature is then increased to about 265° C. (509° F.) and the fibers hold 10 minutes. Finally, the fibers are heated to about 305° C. (581° F.) and held 10 minutes at this temperature. The physical properties of these fibers after heating them to about 1100° C. (2000° F.) in a nitrogen atmosphere for two hours in order to convert them to carbon fibers is presented in Table VI.

By "oxidizing" environment it is meant either an oxidizing atmosphere or an oxidizing material impregnated within or on the surface of the fiber. The oxidizing atmosphere can consist of gases such as air, enriched air, oxygen, ozone, nitrogen oxides, sulfur oxides, and etc. The impregnated oxidizing material can be any of a number of oxidizing agents such as sulfur, nitrogen oxides, sulfur oxides, peroxides, persulfates, and etc.

TABLE VI

| Property | AR-510-TF | A-410-VF |
|---|---|---|
| Tensile Strength, ($10^3$ psi) (ASTM D-3379) | 53 | 41.2 |
| Young's Modulus, ($10^6$ psi) (ASTM D-3379) | 4.3 | 4.1 |
| Diameter, Microns | 13.4 | 22 |
| Number of Fibers Tested | 11 | 10 |

In order to stabilize fibers made from a A-410-VR pitch a heating cycle extending over a period of 36 hours is required. More particularly, they are air stabilized by holding them at a temperature of about 152° C. (306° F.) for 24 hours and then increasing the temperature to 301° C. (574° F.) where they are held for a period of twelve (12) hours. If either temperature is exceeded or time shortened, the fibers begin to melt and fuse during subsequent processing. The fibers when treated properly are carbonized by heating them to 1200° C. (2192° F.) in a nitrogen atmosphere. The physical properties of carbon fibers prepared from the A-410-VR pitch material are set forth in Table VI and are approximately equal to, or slightly inferior to, the properties of the fibers prepared from the AR-510-TF pitch material as set forth in Table VI above.

As noted above, in the air stabilization of fibers made from the AR-510-TF material or from other high softening point pitch materials, it has been found that the air stabilization is much more effective where the fibers are first heated to a temperature of about 6° to 11° C. (10° to 20° F.) below the glass transition temperature of the pitch precursor and thereafter after a period of time of approximately 50 minutes are then heated to 299°-316° C. (570°-600° F.) until they are stabilized. As used herein, the "glass transition point" represents the temperature of Young's modulus change. It also is the temperature at which a glassy material undergoes a change in coefficient of expansion and it is often associated with a stress release. Thermal mechanical analysis is a suitable analytical technique for measuring tg. The procedure employed comprises grinding a small portion of pitch fiber and compacting it into a 0.25" diameter by 0.125" aluminum cup. A conical probe is placed in contact with the surface and a 10 gram load is applied. The penetration of the probe is then measured as a function of temperature as the sample is heated at 10° C./minute in a nitrogen atmosphere. At 6°-11° C. (10°-20° F.) below the glass transition the fibers maintain their stiffness while at the same time the temperature represents the highest temperatures allowable for satisfactory stabilization to occur. This temperature is below the point at which fiber-fiber fusion can occur. After the fiber has been heated at this temperature for a sufficient time to form a skin, the temperature can then be raised at a rate such that the increased temperature is below the glass transition temperature of the oxidized fibers. It has been discovered that during the oxidation of the carbon fibers the glass transition temperature increases and by maintaining the temperature during heat-up at a point 6° to 11° C. (10° to 20° F.) below the glass transition temperature, undesired slumping of the fibers does not occur. As the temperature is increased the oxidation rate increases and conversely the stabilization time decreases.

As noted in the Tables above, the AR-510-TF pitch fiber can be stabilized in a much shorter period of time than can the A-410-VR fiber. In fact, the time required to stabilize is approximately 25 times longer for the fiber made from an A-410-VR pitch. This decrease in stabilization time is in part due to the increased softening point of the pitch fiber which enables it to be heated to a much higher initial stabilization temperature. It is also due in substantial part to the increased reactivity of the precursor pitch material as contrasted to the lower softening point pitch material from which it was prepared.

As noted, the use of a wiped-film evaporator is presently the preferred method since the high thermal efficiency leads to a decreased exposure of the product to high temperatures, and thus minimizes the formation of higher viscosity dispersed phases, e.g., mesophase, which can result in difficulties in the fiber-forming operation, and can result in discontinuous compositional areas in the final product fiber.

In order to demonstrate that the shortened stabilization cycle is due in large part to the different chemical composition of the pitch materials, the following tests are conducted. Two pitches, samples AR-510-TF (Run 1009) and A-438-VR (Run 5053), are crushed and screened to a −100 mesh 200 mesh sizing (i.e. −150 +75 microns) and then heated at 160° C. (320° F.), 182° C. (360° F.), and 190° C. (375° F.) in circulating hot air. Samples are removed at different times between 16 and 165 hours. The samples are analyzed for both weight change and xylene insolubles content. The rate constants are found by plotting xylene insolubles versus time as a first order relationship. From this evaluation, it is determined that AR-510-TF (Run 1009) oxidizes substantially faster than the A-430-VR (Run 5053). The calculated rate constants are about 25 times faster, a figure which correlates reasonably well with the actual test results. The high softening point pitches of the present invention prepared in 15 seconds or less have a substantially higher reactivity than pitches of the prior art.

Various methods besides wiped-film evaporation may be employed to increase the softening point of the pitch without adversely affecting its reactivity. Solvent extraction, oxidation, nitrogen stripping and flash distillation may be employed. A brief description of each will now be provided.

One method which can be used to produce a high softening point pitch material is solvent extraction. Three extraction methods can be used. They are: (1) supercritical extraction; (2) conventional extraction; and (3) solvent/nonsolvent extraction. These methods greatly reduce the temperature to which the catalytic pitch is subjected, thus providing a spinnable pitch. Extraction is a method that removes lower molecular weight materials, thus leaving a fiber precursor pitch.

Extraction processes can be used in several modes to convert the catalytic pitch to a fiber precursor pitch. In one mode, a solvent having preferential solvent power for low molecular weight aromatic compounds, e.g., cyclohexane, is employed to extract about 50 weight % or more of the catalytic pitch. The non-dissolved residue of the extraction process is the fiber precursor pitch. In a second mode, a multi-step extraction process is employed. First, a suitable solvent in a relatively large proportion is employed to dissolve up to about 95 weight % of the catalytic pitch. The residue contains any entrained insoluble particulates and is discarded. The solvent solution then is treated to precipitate about 40–60 weight % of the dissolved pitch components, which constitute the fiber precursor pitch. The precipitation can be effected by evaporating a portion of the solvent (preferably under vacuum) or by adding a non-solvent to the pitch solution.

In supercritical extraction, the pitch is pumped into a pressure vessel where it is continuously extracted with a solvent at pressures above the critical pressure of the solvent. The usual solvents for this process are normal aliphatic hydrocarbons, although the process is not limited to these solvents. The solvent, along with the part of the pitch that is solubilized, is passed through one or a series of pressure step-down vessels where the solvent is flashed off. The insoluble portion is used as the fiber precursor pitch. The softening point of the insoluble fraction i adjusted by varying the temperature at which the extraction is conducted.

Figure 3:
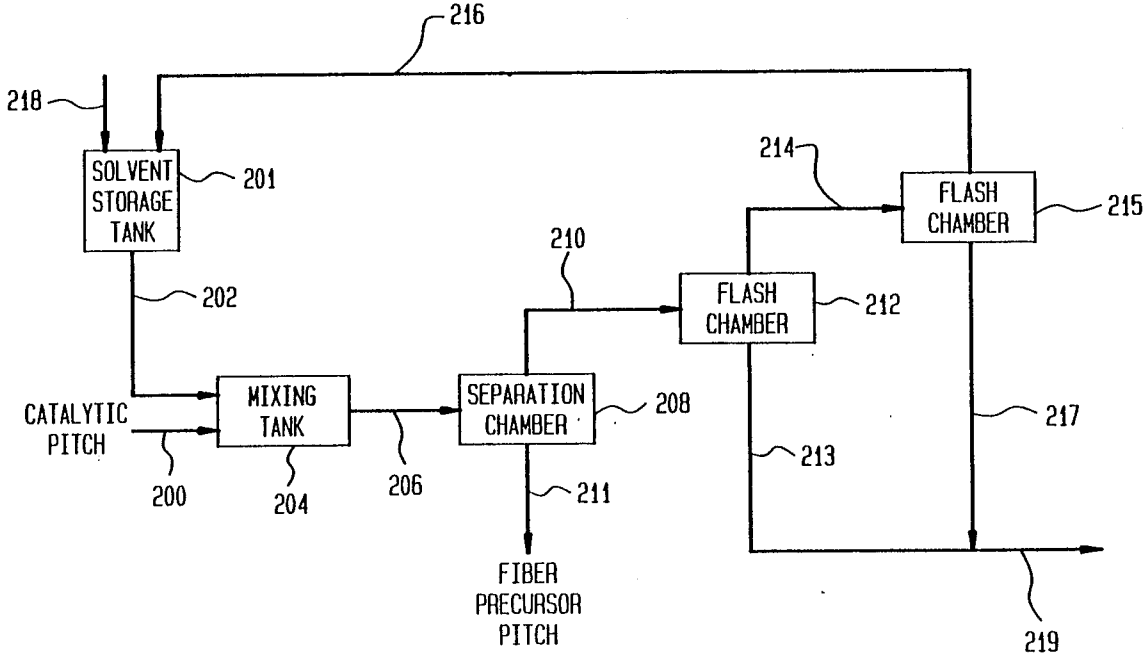
FIG. 3 discloses an apparatus and method for converting a thermal petroleum pitch to spinnable pitch by a super critical extraction process.

FIG. 3 illustrates apparatus and a method for converting thermal petroleum pitch to spinnable pitch by a supercritical extraction process.

Catalytic pitch from line 200 and a solvent such as pentane from line 202 are fed to mixing tank or static mixer 204 in a ratio of about 3 parts by weight of solvent per 100 parts by weight of the pitch. The temperature in tank 204 is maintained at about 200° C. and a pressure of about 4,000 psig is developed, which is well above the solvent's critical pressure. The pitch is only partially soluble in the pentane under these conditions. Sufficient agitation is provided, however, to disperse the undissolved pitch components uniformly throughout the pentane solution. This material then is transferred from tank 204 by line 206 into a non-agitated separation chamber 208. The pressure and temperature in chamber 208 are maintained at the same conditions attained in mixing tank 204. In separation chamber 208, the heavier pitch fraction precipitates to the bottom and is removed via line 211. This heavier fraction is a fiber precursor pitch. The solution in separation chamber 208 is removed as overhead via line 210 (containing a one-way pressure let-down valve not shown). The solution is fed to flash chamber 212 at a pressure of about 2000 psig and temperature about 80° C. Some of the pitch precipitates and is removed via line 213. The overhead solution from flash chamber 212 is transported via line 214 (containing a one-way pressure let-down valve not shown) to a second flash chamber 215. Flash chamber 215 is at about ambient pressure and at a temperature of about 80° C. The remainder of the pitch is precipitated and removed via line 217. The solvent overhead is removed via line 216 and transported back to solvent storage tank 201. Line 218 supplies make-up solvent as required. The remaining pitch fractions from the flash chamber are recovered via line 219 for other use.

Another extraction method that can be used to convert catalytic pitch to fiber precursor pitch is a solvent/non-solvent extraction process. This extraction method has the advantage that it also can be used to free the fiber precursor pitch of insoluble particulate matter. The catalytic pitch is dissolved in a solvent such as toluene which will dissolve at least 85% of the pitch. The pitch/toluene solution is then filtered through a small pore filter. This filtration step removes the inorganic impurities and particulates. The pitch/toluene solution is then diluted with a solvent, such as a normal aliphatic hydrocarbon, which has a limited solubility for pitch. Upon the addition of the normal hydrocarbon non-solvent, an insoluble pitch begins to precipitate. When the addition of the normal hydrocarbon is complete, the solution is filtered. The insoluble portion which is removed by filtration is a high softening point fiber precursor pitch which is free of inorganic impurities and particulates. The softening point of the insoluble portion is adjusted by the amount of normal hydrocarbon added to the pitch/toluene solution.

Figure 4:
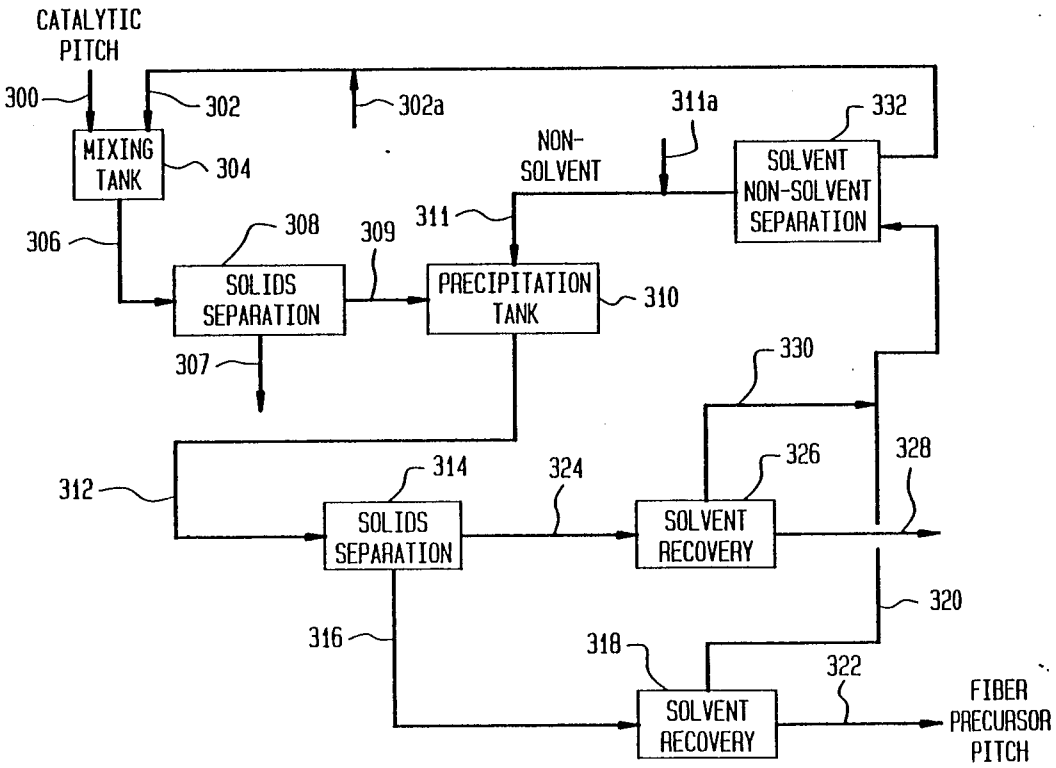
FIG. 4 discloses an apparatus and a method for converting a catalytic pitch to a fiber precursor pitch by a solvent/non-solvent extraction process.

FIG. 4 illustrates apparatus and a method for converting catalytic pitch to fiber precursor pitch by a solvent/non-solvent extraction process.

Catalytic pitch from line 300 and a solvent such as tetralin from line 302 are fed to a mixing tank 304 in a ratio of about 485 parts by weight of solvent per 100 parts by weight of pitch. Heat is supplied to each component by upstream heat exchangers (not shown) to increase the pitch solubility in the solvent. At least 95 weight % of the catalytic pitch dissolves under these conditions. The solution is transferred via line 306 through an ultrafine filtering medium in vessel 308 to remove any insolubles via line 307. The insoluble pitch component occludes any finely divided inorganic particulates which may have been present in the initially charged catalytic pitch. The solution from vessel 308 then is fed via line 309 into precipitation tank 310. A non-solvent such as pentane is fed to tank 310 via line 311 in a quantity sufficient to precipitate approximately 15 to 25 weight % of the pitch, the high molecular weight fractions of which preferentially separate. The two-phase mixture is transferred via line 312 to a solids separation vessel 314. The precipitated pitch fractions are transferred via line 316 to a solvent recovery vessel 318. Any amounts of occluded solvent and non-solvent are volatilized and removed via line 320. The fiber precursor pitch is recovered via line 322.

The miscible solvent/non-solvent mixture from separation vessel 314, which contains the low molecular weight pitch fractions, is transferred via line 324 to a solvent recovery vessel 326. The low molecular weight pitch fractions are recovered via line 328. The volatilized solvent/non-solvent mixture is transferred via line 330 into line 320. The solvent/non-solvent mixture from line 320 is fed to a solvent/non-solvent separation unit 332. The separated non-solvent is recycled to line 311. The separated solvent is recycled to line 302. Line **302*a* supplies make-up solvent as required. Line 311*a*** supplies make-up non-solvent as required. Another extraction method that can be used to convert catalytic pitch to fiber precursor pitch is conventional solvent extraction, such as that used in refinery solvent deasphalting. The catalytic pitch is extracted in an extraction vessel using an extraction solvent at a given temperature and pressure. The usual solvents for this process are normal hydrocarbons although the process is not limited to these solvents. The solvent along with the part of the catalytic pitch that is solubilized is removed to a flash chamber where the solvent is removed. The insoluble part of the catalytic pitch is removed from the bottom of the extractor. This insoluble fraction is a fiber precursor pitch.

Figure 5:
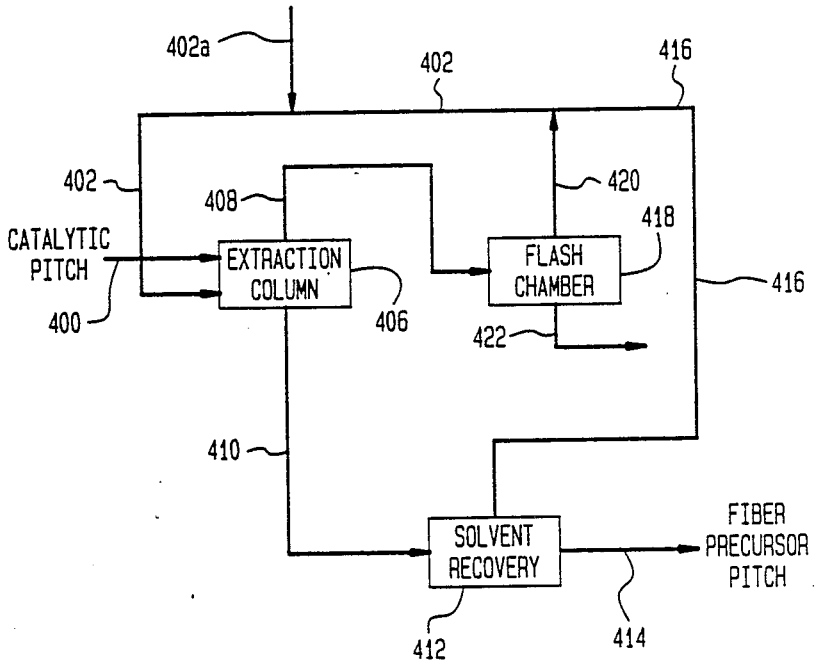
FIG. 5 discloses an apparatus and a method for converting a catalytic pitch to a fiber precursor pitch by conventional solvent extraction process.

FIG. 5 illustrates apparatus and a method for converting catalytic pitch to fiber precursor pitch by a conventional solvent extraction process.

Catalytic pitch from line 400 and an extracting solvent such as a 90/10 cyclohexane-toluene mixture from line 402 are fed to a counter-current extraction column 406 in a ratio of about 2,000 parts by volume of solvent per 100 parts by volume of pitch. The temperature of the incoming pitch and the incoming solvent and their temperature within extracting column 406 are maintained by suitable heat exchangers (not shown) so that the solvent dissolves approximately 50 to 75% by weight of the pitch charged to extraction column 406. The solvent, which has preferentially dissolved the low molecular weight components of the pitch, is removed via line 408, and the high molecular weight, undissolved fractions of the pitch are removed via line 410. The insoluble pitch fraction from line 410 is fed to a solvent recovery unit 412, where any occluded solvent is volatilized and removed via line 416. The fiber precursor pitch is recovered via line 414.

The solvent solution of low molecular weight pitch fractions is fed to a flash chamber 418. The solvent is removed as overhead via line 420 and fed to line 402. The low molecular weight pitch fraction is removed via line 422. A line **402*a*** is provided to add make-up solvent to the system as required.

Fiber precursor pitch can be produced by use of an equilibrium flash distillation still. In such a unit, liquid catalytic pitch is pumped into a preheater zone where the feed is heated to the flash temperature. Directly after heating, the feed enters the flash zone. This zone is a large, well-heated vessel under vacuum where the volatiles are allowed to escape from the liquid phase. The vapors are condensed and collected through an overhead line while the liquid bottoms are allowed to flow out a bottom opening to be collected and used as a fiber precursor pitch.

A characteristic of all the processes described above is that they neither significantly destroy aromatic compounds having alkyl groups attached thereto present in the catalytic pitch (possibly by dealkylation reactions at elevated temperatures) nor do they selectively remove such compounds from the catalytic pitch.

Modifications

It will be understood that the examples are merely illustrative and that the invention is susceptible to a variety of modifications and variations which will become apparent to those skilled in the art upon a reading of the application. References cited above and literature cited therein are hereby incorporated by reference into the application.

What is claimed is:

1. A process for preparing carbon fibers from a catalytic pitch which consists essentially of:

(a) solvent extracting said catalytic pitch to selectively remove therefrom low molecular weight compounds, said solvent extraction being characterized in that it is performed under sufficiently mild time-temperature conditions such that;

(i) the mesophase content of said pitch is not significantly increased and is maintained below 5%, and (ii) alkyl groups attached to aromatic compounds are not preferentially removed from said pitch, (b) recovering from step (a) a fiber precursor pitch having the following properties:

| Property | Value |
|---|---|
| Wt % of aromatic compounds | At least about 95 |
| Wt % of aromatic carbon atoms | At least about 85 |
| Total aliphatic hydrogen atoms, mol % of total hydrogen atoms | 25–65 |
| Aliphatic alpha hydrogen atoms, mol % of total hydrogen atoms | 20–40 |
| Aliphatic beta hydrogen atoms, mol % of total hydrogen atoms | 2–15 |
| Aliphatic gamma hydrogen atoms, mol % of total hydrogen atoms | 1–10 |
| Carbon/hydrogen atomic ratio | At least about 1.5 |
| Wt % xylene insolubles | 15–40 |
| Wt % quinoline insolubles | Less than about 5 |
| Wt % coking value | 65–90 |
| Softening point, °C. | At least about 240 |
| % Mesophase | Less than about 5 |
| Glass transition temp., °C. | 160–220 |
| Wt % ash | Less than about 0.1 |

(c) converting the fiber precursor pitch of step (b) into fibers;

(d) stabilizing the fibers of step (c) by heating them in an atmosphere containing an oxidizing gas at a temperature close to, but at least 5° C. below, the glass transition temperature of the fibers;

(e) transferring the stabilized fibers of step (d) into a zone substantially free of an oxidizing gas, and heating said fibers to a temperature of at least about 1000° C. for a period of time sufficient to increase the fixed carbon content of said fibers to at least about 90 weight %; and (f) recovering the carbon fibers from step (e); the catalytic pitch employed in step (a) having the following properties:

| Property | Value |
|---|---|
| Softening point, °C. | About 40–130° C. |
| Wt % xylene insolubles | Less than about 8 |
| Wt % quinoline insolubles | Nil |
| Wt % coking value | Less than about 48 |
| Carbon/hydrogen atomic ratio | Greater than about 1.2 |
| % Mesophase | Less than about 5 |
| Glass transition temp., °C. | Greater than about 35 |
| Wt % ash | Less than about 0.1 |

2. The process of claim 1 wherein the catalytic pitch is treated with a solvent to preferentially dissolve about 50 weight % or more of low molecular weight components of the catalytic pitch, and the undissolved residue of the catalytic pitch is recovered and is a fiber precursor pitch.

3. The process of claim 2 wherein the solvent employed comprises cyclohexane.

4. The process of claim 2 wherein the solvent employed comprises toluene.

5. The process of claim 1 wherein the solvent extraction is effected by supercritical extraction process.

6. The process of claim 1 wherein the extracting solvent comprises a normal aliphatic hydrocarbon.

7. The process of claim 1 wherein the extracting solvent comprises pentane.

8. The process of claim 1 wherein the solvent extraction is effected by a solvent/non-solvent extraction process.

9. The process of claim 8 wherein essentially all of the catalytic pitch is dissolved in a solvent and a non-solvent then is added to said catalytic pitch solution to precipitate about 25 to 50 weight % of the high molecular weight catalytic pitch components which are recovered and are a fiber precursor pitch.

10. The process of claim 9 wherein the solvent comprises toluene and the non-solvent comprises pentane.

11. A process for separating insoluble particulates from a catalytic pitch which consists essentially of:

(a) contacting the catalytic pitch with a solvent under conditions which dissolve the bulk of, but not all of, said catalytic pitch;

(b) cooling and separating from the solution of (a) the suspended insoluble material; and (c) recovering from (b) a solution of catalytic pitch substantially free of insoluble particulates;

the catalytic pitch employed in step (a) having the following properties:

| Property | Value |
|---|---|
| Softening point, °C. | About 40–130° C. |
| Wt % xylene insolubles | Less than about 8 |
| Wt % quinoline insolubles | Nil |
| Wt % coking value | Less than about 48 |
| Carbon/hydrogen atomic ratio | Greater than about 1.2 |
| % Mesophase | Less than about 5 |
| Glass transition temp., °C. | Greater than about 35 |
| Wt % ash | Less than about 0.1 |

12. The process of claim 11 wherein the solvent employed comprises toluene.

13. A process for separating insoluble particulates from a catalytic pitch which consists essentially of:

(a) contacting the catalytic pitch with a solvent under conditions which dissolve substantially all of said catalytic pitch;

(b) treating the solution of (a) to precipitate therefrom a small percentage of the dissolved catalytic pitch;

(c) separating from the suspension of (b) the suspended insoluble material; and (d) recovering from (c) a solution of catalytic pitch substantially free of insoluble particulates;

the catalytic pitch employed in step (a) having the following properties:

| Property | Value |
|---|---|
| Softening point, °C. | About 40–130° C. |
| Wt % xylene insolubles | Less than about 8 |
| Wt % quinoline insolubles | Nil |
| Wt % coking value | Less than about 48 |
| Carbon/hydrogen atomic ratio | Greater than about 1.2 |
| % Mesophase | Less than about 5 |
| Glass transition temp., °C. | Greater than about 35 |
| Wt % ash | Less than about 0.1 |

14. The process of claim 13 wherein the precipitation in (b) is effected by adding a miscible non-solvent to the catalyst pitch solution.

15. The process of claim 13 wherein the precipitation in (b) is effected by evaporating a portion of the solvent from the catalytic pitch solution.

* * * * *

UNITED STATES PATENT AND TRADEMARK OFFICE

CERTIFICATE OF CORRECTION

PATENT NO. : 4,927,620

DATED : May 22, 1990

INVENTOR(S) : Ward et al.

It is certified that error appears in the above-identified patent and that said Letters Patent is hereby corrected as shown below:

Column 3, Table I, delete "Pyconometer" and insert --Pycnometer--.

Column 4, line 18, delete "Month" and insert --Monty--.

Column 7, line 19, after "are" insert --preferred--.

Column 9, line 39, delete "insulate" and insert --insulated--.

Column 10, Table IV, delete "Pyconometer" and insert --Pycnometer--.

Column 10, Table V (B), delete "Pyconometer" and insert --Pycnometer--.

Signed and Sealed this

Eighteenth Day of February, 1992

*Attest:*

*Attesting Officer*

HARRY F. MANBECK, JR.

*Commissioner of Patents and Trademarks*